US009792810B2

(12) United States Patent
Hille et al.

(10) Patent No.: US 9,792,810 B2
(45) Date of Patent: Oct. 17, 2017

(54) HANDHELD REMOTE CONTROL UNIT FOR ELECTRICAL DEVICES, AND AN ELECTROMOTIVE FURNITURE DRIVE WITH A HANDHELD REMOTE CONTROL UNIT

(71) Applicant: DEWERTOKIN GMBH, Kirchlengern (DE)

(72) Inventors: Armin Hille, Bielefeld (DE); Josef Gross, Friesoythe (DE)

(73) Assignee: DewertOkin GmbH, Kirchlengern (DE)

( * ) Notice: Subject to any disclaimer, the term of this patent is extended or adjusted under 35 U.S.C. 154(b) by 0 days.

(21) Appl. No.: 15/034,100

(22) PCT Filed: Nov. 4, 2014

(86) PCT No.: PCT/EP2014/073696

§ 371 (c)(1),
(2) Date: May 3, 2016

(87) PCT Pub. No.: WO2015/063324

PCT Pub. Date: May 7, 2015

(65) Prior Publication Data

US 2016/0275785 A1 Sep. 22, 2016

(30) Foreign Application Priority Data

Nov. 4, 2013 (DE) ..... 20 2013 104 924 U

(51) Int. Cl.

| | |
|---|---|
| ***G08C 17/02*** | (2006.01) |
| ***A47C 31/00*** | (2006.01) |
| ***A47C 7/62*** | (2006.01) |

(52) U.S. Cl.

CPC ..... *G08C 17/02* (2013.01); *A47C 7/62* (2013.01); *A47C 31/008* (2013.01)

(58) Field of Classification Search

CPC ..... G08C 17/02; G08C 23/04; G08C 17/00; G08C 19/28; G08C 2201/20; G08C 23/02; G08C 2201/21; G08C 2201/32; G08C 2201/92

USPC ..... 340/12.5

See application file for complete search history.

(56) References Cited

U.S. PATENT DOCUMENTS

| | | | | |
|---|---|---|---|---|
| 6,570,491 | B1 | 5/2003 | Bastholm | |
| 7,600,817 | B2 * | 10/2009 | Kramer | A47C 1/022 297/354.13 |
| 8,981,679 | B2 | 3/2015 | Hille | |
| 9,230,764 | B2 | 1/2016 | Hille | |
| 9,252,692 | B2 | 2/2016 | Hille | |
| 9,326,608 | B1 * | 5/2016 | Hoy | A47C 1/03211 |

(Continued)

FOREIGN PATENT DOCUMENTS

| | | |
|---|---|---|
| DE | 36 34 506 A1 | 4/1987 |
| DE | 201 05 993 U1 | 7/2001 |

(Continued)

*Primary Examiner* — Mark Blouin

(74) *Attorney, Agent, or Firm* — Henry M. Feiereisen LLC

(57) ABSTRACT

A remote control unit (10) for electrical devices, in particular functional furniture and electrical accessory devices, is provided. The remote control unit (10) has control elements for controlling at least one associated piece of furniture and control elements for controlling associated electrical devices and associated electrical accessory devices.

18 Claims, 2 Drawing Sheets

(56) References Cited

U.S. PATENT DOCUMENTS

| | | | |
|---|---|---|---|
| 2012/0186019 | A1 | 7/2012 | Rawls-Meehan |
| 2013/0057778 | A1 | 3/2013 | Hale et al. |
| 2013/0096701 | A1 | 4/2013 | Suorajaervi et al. |
| 2014/0152068 | A1 | 6/2014 | Hille |
| 2015/0019020 | A1 | 1/2015 | Hille |
| 2015/0025688 | A1 | 1/2015 | Hille et al. |
| 2015/0026890 | A1 | 1/2015 | Hille et al. |
| 2015/0035457 | A1 | 2/2015 | Hille et al. |
| 2015/0048763 | A1 | 2/2015 | Hille |
| 2015/0054429 | A1 | 2/2015 | Hille et al. |
| 2015/0241857 | A1 | 8/2015 | Hille |

FOREIGN PATENT DOCUMENTS

| | | | |
|---|---|---|---|
| DE | 201 16 908 | U1 | 3/2003 |
| DE | 10 2009 020 209 | A1 | 11/2010 |
| DE | 20 2011 051 662 | U1 | 1/2013 |
| JP | 2010 022554 | A | 2/2010 |

* cited by examiner

HANDHELD REMOTE CONTROL UNIT FOR ELECTRICAL DEVICES, AND AN ELECTROMOTIVE FURNITURE DRIVE WITH A HANDHELD REMOTE CONTROL UNIT

CROSS-REFERENCES TO RELATED APPLICATIONS

This application is the U.S. National Stage of International Application No. PCT/EP2014/073696, filed Nov. 4, 2014, which designated the United States and has been published as International Publication No. WO 2015/063324 and which claims the priority of German Patent Application, Serial No, 20 2013 104 924.7, filed Nov. 4, 2013, pursuant to 35 U.S.C. 119(a)-(d).

BACKGROUND OF THE INVENTION

The invention relates to a handheld remote control unit for electrical devices, in particular for an item of functional furniture and accessory devices. The invention also relates to an electromotive furniture drive with such a handheld remote control unit.

Such handheld remote control units have proven themselves well in practice. Viewed generally, handheld remote control units increase the operating convenience of any electrical device. In practice, this means that the user has to have a plethora of different handheld remote control units at hand and has to change between the handheld remote control units depending on the selection of the device to be operated. A first known solution for obtaining operating convenience relates to a holding unit, which presents the variety of different handheld remote control units in reachable proximity to the operator. A further known solution relates to a type of universal handheld remote control unit, whereby one can manage at least a number of different audio, video, satellite, and television devices by switching over or by free programming. Such handheld remote control units are known as infrared remote control units having unidirectional transmission link.

Electrical devices of a home installation, for example, lights, roller blinds, windows, blinds, heating controller, and others, can also each be provided with a handheld remote control unit, to enable remote control of the respective device of the home installation.

An exemplary handheld remote control unit for an item of functional furniture in the form of an electrically operated armchair is known from DE 201 16 908 U1. A plurality of electrical devices which are arranged in the furniture can be operated thereby. Electrical adjustment motors for movable armchair components or electrical massage units, which are installed or integrated in the armchair, would be conceivable. This handheld remote control unit furthermore has a wired transmission link in the form of a connection cable, whereby the control signals are fed into a control unit of the armchair.

An item of functional furniture is provided with at least one electromotive furniture drive. Such an electromotive furniture drive is attached in the furniture, which has fixed and movable furniture components. Fixed furniture components are, for example, frame components. Movable furniture components are, for example, solid or springy-yielding support surfaces of upholstery or a mattress of seating and/or recumbent furniture.

The electromotive furniture drive is used for adjusting the movable furniture components. In this case, the adjustment movement and drive force generated by the electromotive furniture drive are transmitted to the respective movable furniture component, wherein the electromotive furniture drive is supported on a fixed furniture component and adjusts the movable furniture component in relation to the fixed furniture component. The electromotive furniture drive can also be attached between two movable furniture components, wherein it can adjust them in relation to one another.

Electromotive furniture drives are known from the prior art in a variety of different embodiments for different usage cases and purposes, for example, as single drives, double drives, and multiple drives. An electromotive furniture drive can be provided with a control device, which is connected to a handheld remote control unit.

Furthermore, different items of functional furniture having different functions are known. The execution of the functions can be performed by electrical devices. Such functions are, for example, adjustment of movable furniture parts by means of electromotive furniture drives, massage devices, heaters, lights, and others. The electrical devices are integrated in the functional furniture.

It is also possible that some functions are not integrated in the item of functional furniture, but rather are attached as electrical accessory devices and are removable again, for example, heating cushions, massage units, and others.

A shared handheld remote control unit, typically together with an electromotive furniture drive, is associated with the electrical devices integrated in the item of functional furniture. The removable electrical accessory devices can each have a separate handheld remote control unit having a separate controller. However, it is also possible that specific, removable devices are connectable later to a shared control device of the functional furniture.

Furthermore, items of furniture having electrical devices, for example, cabinets, dressers, and the like having different lights are also known. Handheld remote control units can also be used here.

SUMMARY OF THE INVENTION

The object of the present invention is an improvement of the prior art, to substantially increase the operating convenience for the user, who wishes to simultaneously operate an item of functional furniture and further, different electrical devices.

The achievement of the stated object is a handheld remote control according to the invention of the type mentioned at the outset, which comprises operating elements for operating at least one item of functional furniture and operating elements for operating assigned electrical devices and assigned electrical accessory devices.

A further achievement of the stated object is a handheld remote control unit according to the invention for an assigned item of functional furniture, which comprises operating elements for operating assigned electrical devices and assigned electrical accessory devices.

Still a further achievement relates to an electromotive drive according to the invention having a handheld remote control unit according to the invention.

One embodiment of the handheld remote control unit according to the invention is designed so that the at least one assigned item of functional furniture comprises at least one electromotive furniture drive.

An item of functional furniture is designed as a seating and/or recumbent item of furniture and comprises integrated motorized adjustable components, which are adjustable by at least one electromotive furniture drive.

A further embodiment provides that the at least one assigned item of functional furniture comprises at least one integrated electrical device, which is connected to a control unit of the functional furniture. Such an integrated electrical device can be, for example, an electrical massage unit or an electrical unit such as a lamp. A field of use is therefore advantageously expanded.

Still a further advantage is achieved if the handheld remote control unit according to the invention is designed so that, in another embodiment, the electrical devices can comprise electrical devices which are arranged in surroundings of the setup location of the item of functional furniture, for example, electrical devices of entertainment electronics, lights, and heaters.

In a further advantageous embodiment of the handheld remote control unit according to the invention, it is embodied so that the electrical devices can comprise electrical devices of a home installation, for example, lights, roller blinds, windows, blinds, or a heating controller.

It is additionally possible with another embodiment of the handheld remote control unit according to the invention that the electrical accessory devices can be electrical devices which are arranged on or in the item of functional furniture and are independent of a control unit of the item of functional furniture.

Because the handheld remote control unit according to the invention is designed as described above for operating items of functional furniture and further electrical devices, an advantageously large field of use is enabled. Electrical devices which are associated with the surroundings of the setup location of the functional furniture are, for example, audio, video, satellite, or television devices. Devices of the home or building installation are, for example, permanently installed lamps. Further electrical devices, for example, lights, can also be integrated in items of furniture.

For this purpose, the handheld remote control unit according to the invention comprises at least one transmission link. By means of the at least one transmission link, the handheld remote control unit according to the invention is connected to a control unit or a control device of the item of functional furniture for control and operation of adjustment motors and/or electrical massage units.

A first embodiment of a transmission link is a wired transmission link having a connection cable. A further embodiment of a transmission link is designed as wireless. A first wireless transmission link is designed as an infrared transmission link. A further wireless transmission link is designed as a radio transmission link.

A first embodiment of a handheld remote control unit according to the invention comprises one transmission link.

An alternative of a handheld remote control unit according to the invention comprises a number of identical transmission links. A preferred alternative of a handheld remote control unit according to the invention comprises a number of different transmission links.

At least one transmission link can be constructed as multilingual if, for example, it is designed as an infrared transmission link and can transmit various transmission frequencies and/or various transmission protocols. This is important in particular if various accessory devices having infrared remote operability and optionally an item of functional furniture having the same infrared remote operability are to be operated. In other words, such a handheld remote control unit according to the invention comprises multiple infrared transmission links, wherein at least one is designed for operating accessory devices and a further one is designed for operating items of functional furniture.

A special embodiment of a handheld remote control unit according to the invention comprises a radio transmission link and an infrared transmission link. In this case, the radio transmission link is operationally connected to the control unit of the item of functional furniture, while the infrared transmission link is connected to an accessory device, for example, a television.

To operate the additional electrical device, the handheld remote control unit according to the invention comprises operating elements in the form of operating buttons or in the form of operating panels. Operating panels can be designed as touch-sensitive surface sections and can be part of a touchpad or a touchscreen, for example. Operating buttons are connected to mechanical push switches.

The handheld remote control unit according to the invention furthermore has a unit for synchronization with a device remote control unit of an additional electrical device. For this purpose, the relevant control commands of the device remote control unit of the additional electrical device are fed into the handheld remote control unit according to the invention and stored in the handheld remote control unit according to the invention for further retrieval. The storage of the control commands in the handheld remote control unit according to the invention is performed in that the relevant control commands of the device remote control unit of the additional electrical device are transmitted to the handheld remote control unit according to the invention, while it is in a storage or learning mode, so that a copy of the relevant control commands of the device remote control unit of the additional electrical device is stored in the handheld remote control unit according to the invention and can be retrieved again to operate the additional electrical device.

BRIEF DESCRIPTION OF THE DRAWING

The invention will be explained in greater detail on the basis of the appended drawings. In the figures.

DETAILED DESCRIPTION OF PREFERRED EMBODIMENTS

Figure 1:
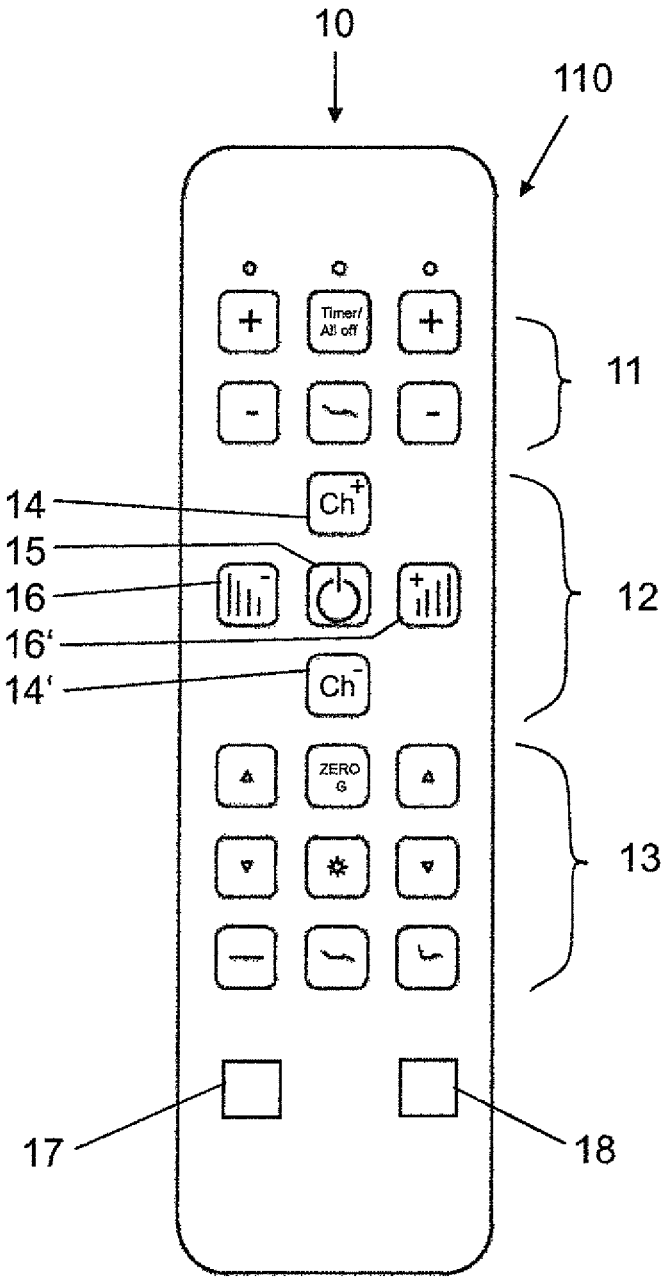
FIG. 1 shows a schematic top view of an exemplary embodiment of a handheld remote control unit according to the invention.
Figure 2:
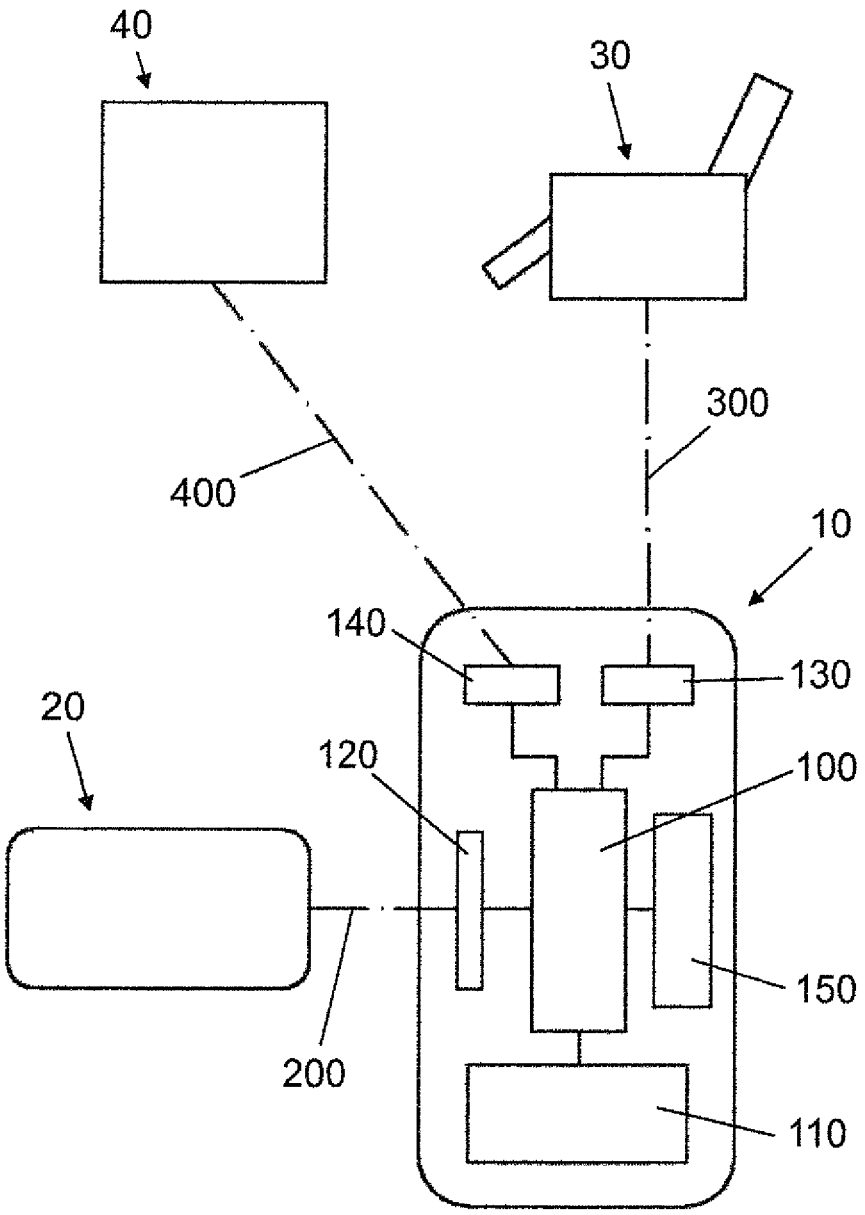
FIG. 2 shows a schematic block diagram of the exemplary embodiment according to FIG. 1 in an exemplary context with electrical devices.

FIG. 1 shows a schematic top view of an exemplary embodiment of a handheld remote control unit 10 according to the invention. FIG. 2 shows a schematic block diagram of the exemplary embodiment according to FIG. 1 in an exemplary context with electrical devices.

The handheld remote control unit 10 is designed for remote control of an item of functional furniture 30 and comprises an operating unit 110 in the form of operating buttons in operating panels 11, 12, 13 for operating the item of functional furniture 30 and accessory devices. The item of functional furniture 30 is shown here as an example as an adjustable item of seating furniture with electromotive drives. It additionally comprises, for example, an electromotive massage unit and a heater as auxiliary functions. A television is shown as an example of an electrical device 40.

The handheld remote control unit 10 is designed having a housing having a front side and a rear side. The front side is provided with operating panels 11, 12, 13, which comprise a plurality of buttons/switches having different symbols for different operating functions here. In this exemplary embodiment, the operating elements of the first operating panel 11 and the third operating panel 13 are used for operating the item of the functional furniture 30.

The second operating panel 12 is designed for operating the accessory device or an additional electrical device 40, for operating a television here. According to this exemplary embodiment, the operating elements 14 and 14' are intended for changing the television channel, while the operating elements 16 and 16' are used for adjusting the volume. The television or electrical device 40 is turned on and off using the centrally arranged operating element 15.

In one embodiment, further electrical devices come into consideration as additional electrical devices, which are associated with the surroundings of the setup location of the item of functional furniture, for example, audio, video, satellite, or television devices. In a further embodiment, devices of the building installation, for example, permanently installed lamps, can also be designed as additional devices. In still a further embodiment, other items of furniture having lamps are designed as additional devices.

The buttons/switches and operating elements 14, 14', 15, 16, 16' are embodied here, for example, in the form of operating buttons. Operating buttons are connected to mechanical push switches. It is also possible that the operating panels 11, 12, 13 are designed as touch-sensitive surface sections, wherein they can each be a part of a touchpad or a touchscreen, for example.

If the operating panels 11, 12, 13 are designed as touch-sensitive surface sections, the surface sections are associated with respective sensors, for example, touch sensors.

A further operating element is identified here as a learning operating element 17. The learning operating element 17 can also be a button, for example, and is used to carry out a learning procedure of a device remote control unit 20, which is originally associated with the electrical device 40. The learning procedure comprises receiving and storing or learning of control signals of the device remote control unit 20. In this case, the functions of activating or preparing a learning mode and carrying out the learning mode are provided with the learning operating element 17 when carrying out the learning procedure.

Instead of the learning operating element 17—if it is omitted or is already associated with another function—the functions thereof can also be associated with a combination of two or more buttons/switches of the operating panels 11, 12, 13. For example, previously defined buttons/switches of the first operating panel 11 and/or the third operating panel 13 are then to be actuated simultaneously and/or successively for the respective desired function. Of course, button/switches of the second operating panel 12 can also be used in this case.

An additional switchover element is shown with the reference sign 18, which is used for switching over previously definable operating elements of the operating panels 11 and/or 13 from control functions for the item of functional furniture 30 to control functions for the electrical device 40.

The function of the switchover element 18 can also be associated, in a manner which is not shown, but is comprehensible, with a combination of other buttons/switches of the operating panels 11, 12, 13.

The handheld remote control unit 10 is equipped with an electrical power source, which is located in the interior of the housing. This electrical power source can be a battery, a rechargeable battery, or an accumulator cell. The electrical power source can be replaceable, wherein a compartment closable by a cover is arranged for it, for example, accessible from the rear. It is also possible that the electrical power source is enclosed in a rechargeable embodiment in the housing, wherein it is only possible to change it by means of a tool or by partial or complete destruction of the housing. Charging of the rechargeable electrical power source can be performed through a terminal, for example, a plug connection, or via a wireless induction unit.

FIG. 2 additionally shows an exemplary block diagram of the handheld remote control unit 10. It comprises a control unit 100, the operating unit 110, three transmission units 120, 130, 140, and a storage unit 150.

The control unit 100 is connected to the operating unit 110, the transmission units 120, 130, 140, and the storage unit 150.

The first transmission unit 120 is used for communication with the device remote control unit 20, which is originally associated with the electrical device 40. A unit for synchronization with the device remote control unit 20 is therefore possible. For this purpose, during the above-mentioned learning procedure, the relevant control commands of the device remote control unit 20 are fed into the handheld remote control unit 10 via the first transmission unit 120 and stored in the handheld remote control unit 10 in the storage unit 150 for further retrieval. The storage of the control commands in the handheld remote control unit 10 is performed in that the relevant control commands of the device remote control unit 20 are transmitted to the handheld remote control unit 10, while it is in the storage mode of the learning procedure, so that a copy of the relevant control commands of the device remote control unit 20 is stored in the handheld remote control unit 10 and can be retrieved again to operate the electrical device 40.

The storage of the control commands of the device remote control unit 20 in the handheld remote control unit 10 is controlled here in the learning procedure, as mentioned above, by the learning operating element 17. For example, the control buttons of the device remote control unit 20 are actuated successively, wherein the learning operating element 17 is pressed or turned on simultaneously.

The device remote control unit 20 is connected to the first transmission unit 120 of the handheld remote control unit 10 by a first transmission link 200, which is a wireless infrared link here, for example. Of course, other embodiments are also possible. The first transmission link 200 is also referred to here as the learning transmission link.

A communication of the handheld remote control unit 10 with the item of functional furniture 30 is formed by a second transmission link 300, which connects the second transmission unit 130 to a controller (not shown) of the item of functional furniture 30. This second transmission link 300 can be wireless or also wired and is also called the functional furniture transmission link here.

If the operating panels 11, 12, 13 are all or only partially designed having surface sections with sensors for actuation as a touchpad and/or touchscreen, the sensors are connected to an analysis unit (not shown here). Upon touching of the respective surface section to actuate a function, the respective signal relays a signal and/or a signal sequence to the analysis unit. In this manner, an actuation is detected as a touch of the respective surface section. The analysis unit generates a switching signal in the event of an actuation thus detected. This switching signal is to be equated to a control command in an output signal of a typical, for example, electromechanical operating button/switch.

Furthermore, the handheld remote control unit 10 communicates with the electrical device 40 via a third transmission link 400, which is arranged between the third transmission unit 140 of the handheld remote control unit 10 and a controller (not shown) of the electrical device 40 for communication. The third transmission link 400 is also referred to as the device transmission link here.

The operating buttons in the region 11 and in the region 13 are designed for operating the item of functional furniture 30 and, at the press of a button, allocate control commands to the assigned functional furniture transmission link, as the second transmission link 300, for example, as a radio link. The operating buttons in the region 12 are designed for operating the electrical device 40, a television here, and, at the press of a button, allocate control commands to the assigned device transmission link, as the third transmission link 400, for example, as an infrared transmission link.

In one example, the functional furniture transmission link can be designed, as the second transmission link 300, as a radio link and can be connected to a control unit of the item of functional furniture 30, wherein the device transmission link can be designed, as the third transmission link 400, for example, as an infrared transmission link, and can be connected in this example to the television 40.

At least one of the transmission links 200, 300, 400 can be constructed as multilingual, for example, if it is designed as an infrared transmission link and can transmit various transmission frequencies and/or various transmission protocols. This is important in particular if various accessory devices having infrared remote operability and optionally the item of functional furniture 30 having the same infrared remote operability are to be operated. In other words, such a handheld remote control unit 10 has multiple infrared transmission links 200, 300, 400, wherein at least one of them is designed for operating additional electrical devices 40 and accessory devices on and/or at the item of functional furniture 30, and a further one is designed for operating the item of functional furniture 30.

A flashlight function of the handheld remote control unit 10 is not shown, but is easily conceivable. For this purpose, for example, a high-power light-emitting diode or a light-emitting diode array is provided, which can be turned on and off by an operating element.

The handheld remote control unit 10 can also have a display unit (not shown).

It is conceivable that the handheld remote control unit 10 is coupled to the item of functional furniture 30 via a wired connection. In this case, the electrical power supply of the handheld remote control unit 10 can be performed by the controller of the item of functional furniture 30 via the now wired functional furniture transmission link as the second transmission link 300.

Furthermore, it is also conceivable that more operating elements than those of the second operating panel 12 can be allocated to functions for the electrical device 40 or more devices 40. In this case, it is possible to switch over the function allocation of these operating elements, for example, using the switchover element 18. Of course, these function allocations can also be switched over and/or retrieved in a menu-controlled manner.

It is also conceivable that combinations of buttons/switches of the operating panels 11, 12, 13 can also be associated with additional functions, for example, of the item of functional furniture 30, the device 40, another additional device, and/or also functions for programming and/or button allocation of the handheld remote control unit 10.

In addition, it can be possible that a single, multilingual, and bidirectional transmission link is provided, which has the functions of the three described transmission links 200, 300, 400.

Of course, the handheld remote control unit according to the invention can also be designed for more than three transmission links.

What is claimed is:

1. A handheld remote control unit, comprising:

first operating elements for operating an item of functional furniture;

second operating elements for operating an electrical device;

a first transmission unit in communication via a first transmission link with the item of functional furniture;

a second transmission unit in communication via a second transmission link with the electrical device;

a third transmission unit for communication with a device remote control unit via a third transmission link; and a synchronization unit for synchronization with the device remote control unit via the third transmission unit, wherein the synchronization unit is configured to receive and store control commands of the device remote control unit.

2. The handheld remote control unit of claim 1, wherein one of the first and second transmission links is an infrared transmission link.

3. The handheld remote control unit of claim 2, wherein the other one of the first and second transmission links is a radio transmission link.

4. The handheld remote control unit of claim 1, further comprising at least one storage unit configured to store received control commands of the device remote control unit.

5. The handheld remote control unit of claim 1, wherein the third transmission link is an infrared transmission link.

6. In combination:

an item of functional furniture;

an electrical device; and a handheld remote control unit comprising first operating elements for operating the item of functional furniture, second operating elements for operating the electrical device, a first transmission unit in communication via a first transmission link with the item of functional furniture, a second transmission unit in communication via a second transmission link with the electrical device, a third transmission unit for communication with a device remote control unit via a third transmission link, and a synchronization unit for synchronization with the device remote control unit via the third transmission unit;

wherein the synchronization unit is configured to receive and store control commands of the device remote control unit.

7. The combination of claim 6, wherein the item of functional furniture comprises at least one electromotive furniture drive.

8. The combination of claim 6, wherein the item of functional furniture comprises a control unit and at least one integrated electrical device, which is connected to the control unit.

9. The combination of claim 6, wherein the electrical device is configured for arrangement in a surrounding area of a setup location of the item of functional furniture.

10. The combination of claim 6, wherein the electrical device is configured for home installation.

11. The combination of claim 6, wherein the electrical device is configured for arrangement on and/or in the item of functional furniture and independent of a control unit of the item of functional furniture.

12. The combination of claim 6, wherein the third transmission link is an infrared transmission link.

13. An electromotive furniture drive for adjusting a movable component of an item of functional furniture, comprising at least one handheld remote control unit for operation, said handheld remote control unit comprising first operating elements for operating the item of functional furniture, second operating elements for operating the electrical device, a first transmission unit in communication via a first transmission link with the item of functional furniture, a second transmission unit in communication via a second transmission link with the electrical device, a third transmission unit for communication with a device remote control unit via a third transmission link, and a synchronization unit for synchronization with the device remote control unit via the third transmission unit, wherein the synchronization unit is configured to receive and store control commands of the device remote control unit.

14. The electromotive furniture drive of claim 13, wherein one of the first and second transmission links is an infrared transmission link.

15. The electromotive furniture drive of claim 14, wherein the other one of the first and second transmission links is a radio transmission link.

16. The electromotive furniture drive of claim 13, wherein the handheld remote control unit includes at least one storage unit configured to store received control commands of the device remote control unit.

17. The electromotive furniture drive of claim 13, wherein the third transmission link is an infrared transmission link.

18. A method of carrying out a learning procedure between a handheld remote control unit and a device remote control unit of an electrical device using a synchronization unit on the handheld remote control unit, comprising:

establishing communication between the handheld remote control unit and the device remote control unit using a transmission link;

synchronizing via the transmission link the device remote control unit with the handheld remote control unit using the synchronization unit on the handheld remote control unit;

receiving control commands of the device remote control unit using the synchronization unit; and storing the control commands of the device remote control unit in at least one storage unit in the handheld remote control unit.

* * * * *